US009915442B2

(12) United States Patent
Driussi et al.

(10) Patent No.: US 9,915,442 B2
(45) Date of Patent: Mar. 13, 2018

(54) MONITORING FAULTS IN THE HEATING CIRCUIT OF AN APPLIANCE

(75) Inventors: Paolo Driussi, Zappola (IT); Marco Lorenzi, Porcia (IT)

(73) Assignee: Electrolux Home Products Corporation N.V., Brussels (BE)

( * ) Notice: Subject to any disclaimer, the term of this patent is extended or adjusted under 35 U.S.C. 154(b) by 763 days.

(21) Appl. No.: 13/697,832

(22) PCT Filed: May 12, 2011

(86) PCT No.: PCT/EP2011/057674

§ 371 (c)(1),
(2), (4) Date: Jan. 3, 2013

(87) PCT Pub. No.: WO2011/141536

PCT Pub. Date: Nov. 17, 2011

(65) Prior Publication Data

US 2013/0126517 A1 May 23, 2013

(30) Foreign Application Priority Data

May 14, 2010 (IT) ..... MI2010A0862

(51) Int. Cl.
*H05B 3/68* (2006.01)
*F24H 9/20* (2006.01)
(Continued)

(52) U.S. Cl.
CPC ..... *F24H 9/2014* (2013.01); *A47L 15/0049* (2013.01); *D06F 33/02* (2013.01);
(Continued)

(58) Field of Classification Search
CPC ..... D06F 25/00; D06F 39/04; D06F 58/26; D06F 33/02
(Continued)

(56) References Cited

U.S. PATENT DOCUMENTS 2,851,790 A 9/1958 Worst
3,112,187 A * 11/1963 Stone ..... 34/527
(Continued)

FOREIGN PATENT DOCUMENTS

EP 0 924 331 6/1999
EP 0924331 * 6/1999 ..... 34/527
(Continued)

OTHER PUBLICATIONS

Machine Translation of EP0924331; Aug. 17, 2016.*
(Continued)

*Primary Examiner* — Tu B Hoang
*Assistant Examiner* — Thomas Ward
(74) *Attorney, Agent, or Firm* — Banner & Witcoff, Ltd.

(57) ABSTRACT

A household appliance has a heating circuit (140) for heating a fluid including a heating element (150) that can be selectively energized (155) to determine the heating of the fluid, and a monitoring unit (125) for monitoring the operation of the heating circuit. The monitoring unit (125) is configured to monitor at least one electrical potential internal to the heating circuit (140). The at least one electric potential internal to the heating circuit (140) is at least one among: an internal electric potential detected at a first terminal (**160*b*) of the heating element (150) connected to an on/off switch (155) of the heating circuit (140); an internal electric potential detected at a second terminal (160*a*) of the heating element (150) connected to a main switch (135) of the appliance or to a safety switch provided for switching the heating circuit off in case of malfunction of the on/off switch (155). The monitoring unit (125**) is further configured for: detecting a value of the voltage of the electricity distribution network; and calculating, starting from the detected value of the voltage of the electricity distribution network, first and a second reference electric potentials, comparing the at least
(Continued)

one detected internal electric potential with the first and second reference electric potentials; recognizing a state of good operation or malfunction of the heating circuit (140) in case the at least one detected internal electric potential does not fall within a range of values between the first and second reference electric potentials.

16 Claims, 1 Drawing Sheet

(51) Int. Cl.

| | |
|---|---|
| ***A47L 15/00*** | (2006.01) |
| ***D06F 33/02*** | (2006.01) |
| ***D06F 37/42*** | (2006.01) |
| ***D06F 39/04*** | (2006.01) |
| *A47L 15/42* | (2006.01) |
| *A47L 15/46* | (2006.01) |

(52) U.S. Cl.
CPC ..... *D06F 37/42* (2013.01); *D06F 39/04* (2013.01); *A47L 15/4285* (2013.01); *A47L 15/46* (2013.01); *A47L 2401/26* (2013.01); *A47L 2401/30* (2013.01); *A47L 2501/06* (2013.01); *A47L 2501/11* (2013.01); *A47L 2501/26* (2013.01); *A47L 2501/28* (2013.01); *A47L 2501/32* (2013.01); *D06F 2202/12* (2013.01)

(58) Field of Classification Search
USPC ..... 34/553, 527, 493, 507, 528; 392/466, 392/486; 37/141, 183; 219/507, 509
See application file for complete search history.

(56) References Cited

U.S. PATENT DOCUMENTS

| | | | | |
|---|---|---|---|---|
| 3,180,038 | A | | 4/1965 | Chafee |
| 3,266,167 | A | | 8/1966 | Finnegan |
| 3,409,994 | A | | 11/1968 | Menk |
| 3,417,480 | A | | 12/1968 | Thunander |
| 3,475,830 | A | | 11/1969 | Botts et al. |
| 3,609,873 | A | | 10/1971 | Odle, Jr. et al. |
| 3,942,265 | A | | 3/1976 | Sisler et al. |
| 4,019,259 | A | | 4/1977 | Veraart |
| 4,083,118 | A | * | 4/1978 | Cotton ..... 34/562 |
| 4,208,890 | A | | 6/1980 | Wood |
| 4,642,907 | A | | 2/1987 | Best |
| 5,564,831 | A | | 10/1996 | Bashark |
| 6,064,043 | A | | 5/2000 | Livers, Jr. et al. |
| 6,079,121 | A | | 6/2000 | Khadkikar et al. |
| 6,246,831 | B1 | | 6/2001 | Seitz et al. |
| 7,594,343 | B2 | | 9/2009 | Woerdehoff et al. |
| 8,015,726 | B2 | | 9/2011 | Carow et al. |
| 2009/0064722 | A1 | | 3/2009 | Lee |
| 2013/0061488 | A1 | | 3/2013 | Lorenzi et al. |
| 2013/0119047 | A1 | | 5/2013 | Driussi et al. |
| 2013/0126517 | A1 | | 5/2013 | Driussi et al. |

FOREIGN PATENT DOCUMENTS

| | | |
|---|---|---|
| EP | 1 744 248 | 1/2007 |
| EP | 2 085 836 | 8/2009 |
| JP | 09 024197 | 1/1997 |

OTHER PUBLICATIONS

International Search Report issued in corresponding International Application No. PCT/EP2011/057674, dated Aug. 19, 2011.
Italian Search Report and Opinion issued in corresponding Italian Application No. MI2010A000862, dated Jan. 26, 2011.
International Search Report dated Sep. 9, 2011 in International Application No. PCT/EP2011/056531 corresponding to related U.S. Appl. No. 13/697,835.
European Search Report dated Nov. 17, 2010 European Application No. 10162839.4 corresponding to related U.S. Appl. No. 13/697,835.
International Search Report dated Sep. 13, 2011 in International Application No. PCT/EP2011/0057712 corresponding to related U.S. Appl. No. 13/697,838.
European Search Report dated Nov. 9, 2010 in European Application No. 10162838.6 corresponding to related U.S. Appl. No. 13/697,838.
Oct. 20, 2016—U.S. Final Rejection—U.S. Appl. No. 13/697,835.
Jun. 30, 2014—U.S. Notice of Allowance—U.S. Appl. No. 13/697,838.
May 7, 2015—U.S. Office Action—U.S. Appl. No. 13/697,835.
Sep. 10, 2015—U.S. Office Action—U.S. Appl. No. 13/697,835.
Mar. 18, 2016—U.S. Office Action—U.S. Appl. No. 13/697,835.
Mar. 30, 2017—U.S. Office Action—U.S. Appl. No. 13/697,835.

* cited by examiner

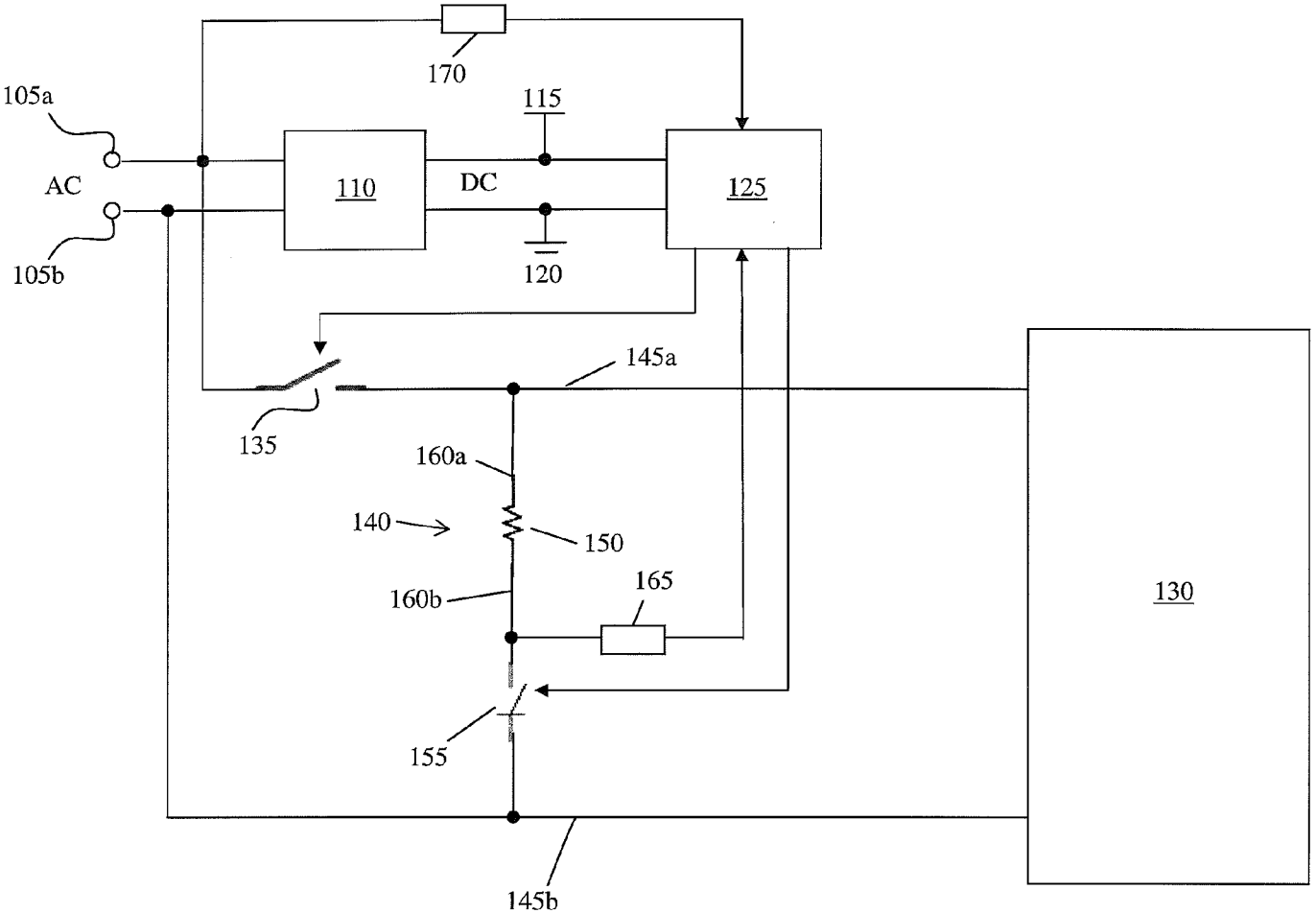
130
125
145a
165
150
145b
115
120
DC
170
160a
160b
155
110
140
135
105a
AC
105b

MONITORING FAULTS IN THE HEATING CIRCUIT OF AN APPLIANCE

The present invention generally relates to the field of household appliances, and particularly to household appliances such as washing machines, laundry washer/dryers, laundry dryers, dishwashers, and in general to all those appliances that include a heating circuit for heating a fluid (laundry or dishes washing liquid, or air for drying the laundry).

The heating circuits provided in the above-mentioned appliances usually include a heating element consisting of a resistor, and a switch (e.g. a relay controlled by a control unit of the appliance) to selectively provide energy to the resistor when required, e.g. for heating the laundry or dishes washing liquid, or for heating the flow of laundry drying air.

The heating circuit is monitored to assess its proper operation or to detect possible faults thereof. Faults can occur in particular in the heating resistor or in the switch that supplies it. The monitoring of the heating circuit serves to assess if the heating resistor is energized or not, or if it is shorted to ground. Some faults can be harmful to the appliance or even extremely dangerous for the safety of the users. For example, it is necessary to prevent the heating resistor from overheating, to avoid damage to components of the appliance or fire; a short circuit to ground of the heating resistor is also potentially risky, because the leakage currents can reach the outer casing of the appliance and cause an electric shock to the unaware user. If any such fault is detected, the operation of the appliance should be stopped.

Solutions are known for monitoring the heating circuit that call for detecting one or more electrical potential in certain circuit nodes of the heating circuit, and comparing the measured electrical potential with predetermined values stored in the control unit of the appliance.

The Applicant has observed that this solution exhibits drawbacks, since the different values taken by the nominal AC voltage in different countries, and also the fluctuations in time of the nominal AC voltage value in the same country, make the monitoring impractical and unreliable. For example, in order to take into account the different standards adopted in different countries, it would be necessary to produce differentiated appliances for different markets with different pre-stored electric potential values.

SUMMARY OF SELECTED INVENTIVE ASPECTS

The Applicant has tackled the problem of devising a solution to monitor the heating circuit of an appliance that would overcome the above problems and ensure greater reliability.

According to an aspect of the present invention, an appliance is provided comprising a heating circuit for heating a fluid, said fluid heating circuit comprising a heating element selectively energizable to determine the heating of the fluid, and a monitoring unit for monitoring the operation of the heating circuit, said monitoring unit being configured for:

- monitoring at least one electrical potential internal to the heating circuit,
- detecting a value of the voltage of the electricity distribution network, and
- recognize a state of proper functioning or malfunctioning of the heating circuit on the basis of a comparison between the at least one measured electrical potential internal to the heating circuit and the detected value of the voltage of the electricity distribution network.

In particular, the monitoring unit can be configured to recognize the state of proper functioning or malfunctioning of the heating circuit based on a comparison of the at least one measured electrical potential internal to the heating circuit and at least one reference electrical potential, derived by the monitoring unit in a dynamic way, for example, periodically, during the operation of the appliance, starting from the detected value of the voltage of the electricity distribution network.

The monitoring unit can be configured to calculate, from the detected value of the voltage of the electricity distribution network, a first and a second reference electrical potentials, to be used for the comparison with the at least one measured internal electrical potential, and to recognize the state of proper functioning or malfunctioning of the heating circuit when the at least one measured internal electrical potential does not fall within a range of values between the first and second electrical potentials.

In one embodiment of the present invention, the monitoring unit can be configured for:

- calculating, starting from the detected value of electricity distribution network voltage, a first and a second dimensionless numeric values;
- calculating, starting from the at least one measured internal electrical potential, a third dimensionless numeric value;
- comparing the third dimensionless numeric value with the first and second dimensionless numeric values, and
- recognizing the state of proper functioning or malfunctioning of the heating circuit if the third dimensionless numeric value does not fall within a range of values between the first and second dimensionless numeric values.

These first and second dimensionless numeric values can be calculated periodically.

Said at least one electrical potential internal to the heating circuit may in particular be at least one of:

- an internal electric potential measured at a first terminal of the heating element connected to a heating circuit on/off switch;
- an internal electric potential measured at a second terminal of the heating element connected to a main switch of the appliance or to a safety switch provided to turn the heating circuit off in case of malfunctioning of the on/off switch.

According to another aspect of the present invention, a method is provided of monitoring a heating circuit of an appliance, said heating circuit being provided for heating a fluid and comprising a heating element that can be selectively energized to determine the heating of the fluid, the method comprising:

- monitoring at least one electrical potential internal to the heating circuit,
- detecting a value of a voltage of the electricity distribution network, and
- recognizing a state of proper functioning or malfunctioning of the heating circuit on the basis of a comparison between the at least one measured electrical potential internal to the heating circuit and the detected value of the voltage of the electricity distribution network.

The state of proper functioning or malfunctioning of the heating circuit can for instance be assessed based on a comparison of the at least one measured electrical potential internal to the heating circuit and at least one reference electrical potential, derived in a dynamic way, for example periodically, during the operation of the appliance starting from the detected value of the voltage of the electricity distribution network.

BRIEF DESCRIPTION OF THE DRAWING

These and other features and advantages of the present invention will become more evident from the following detailed description of an exemplary and not limitative embodiment thereof, description that, for better intelligibility, should be read with reference to the attached drawing, which shows a functional block electric schematic of the embodiment of the present invention.

DETAILED DESCRIPTION OF EXAMPLE EMBODIMENTS

In particular, references 105*a* and 105*b* in the FIGURE denote electrical terminals of the appliance (for example, a laundry washing machine, a laundry washer/dryer, a laundry dryer, a dishwasher, and more generally, an appliance that includes a heating circuit for heating a fluid) which, in use, are inserted into a socket of an electrical system of a house, to receive the alternate current (AC), for example, the terminal 105*a* is connected to the terminal of a plug that can be inserted into the socket port connected to the phase voltage, and the terminal 105*b* is connected to the plug terminal that can be inserted into the socket port connected to the neutral. As known, the value of the AC voltage depends on the standard adopted in the generic country; common standards are 220 V@50 Hz nominal (as in the case of the standard adopted in Europe) and 110 V@60 Hz nominal (as in the U.S. standard).

The AC voltage of the electricity distribution network is supplied to a voltage transformer and rectifier assembly 110, to generate one or more direct current (DC) voltage values 115 (referred to a reference voltage or ground 120), for example a voltage of 5 V to supply a logic control unit 125 that includes for example a microprocessor or microcontroller programmed to control the appliance operation.

Block 130 is intended to represent all the components of the appliance which, for their operation, are powered by the alternating voltage of the electricity distribution network, distributed through the appliance by distribution lines 145*a* and 145*b*; such components include, for example, in the case of a washing machine, the electric motor for rotating the drum, the pump for draining the washing/rinsing liquid, the solenoid valve(s) for loading the washing/rinsing water.

A main switch 135, controlled by the control unit 125, allows selectively supplying all the electrical parts of the appliance; the control unit 125 can, for safety reasons, give the consent to the closure of the switch 135 only if the proper closing of a door or porthole of the appliance is detected, thus preventing the appliance from being started if the door is not closed, and switching the appliance off should the door be opened during operation.

Reference 140 identifies a heating circuit, for example, in the case of a washing machine, for heating the washing liquid. The heating circuit 140, in the illustrative embodiment described herein, is connected to the distribution lines 145*a* and 145*b* of the AC network voltage downstream of the main switch 135, however, in alternative embodiments, it may be connected upstream of the switch 135. The heating circuit 140 comprises at least one heating resistor 150, which is connected in series to at least one switch 155, controlled by the control unit 125. The heating resistor 150 is the component which, when supplied, heats up by Joule effect and determines the heating of the laundry or dishes washing liquid or of the flow of air for drying the laundry. The switch 155 can, for example, be a monostable or bistable relay. The control unit 125 controls the closing of the switch 155 when, during an operating cycle of the appliance, the washing liquid, or the flow of laundry drying air, has to be heated. In the example shown, the heating resistor 150 has a terminal 160*a* connected to the phase distribution line 145*a* and a terminal 160*b* connected to a first terminal of the switch 155, and the latter has a second terminal connected to the neutral distribution line 145*b*, but there is nothing that prevents from reversing the positions of the heating resistor 150 and switch 155. At one or both of the terminals 160*a*, 160*b* of the heating resistor 150 thermo-fuses can be provided, for protection against overheating and burning of the resistor 150.

The control unit 125 monitors the proper functioning of the heating circuit 140. To this end, in one embodiment of the present invention, the control unit 125 monitors at least one electrical potential internal to the heating circuit 140, said internal electrical potential being detected at at least one node of the heating circuit. In particular, in the exemplary embodiment here considered, the control unit 125 detects (via a voltage divider 165, such as a resistive voltage divider) the electrical potential at the terminal 160*b* of the heating resistor 150. In alternative embodiments, the at least one internal electrical potential detected by the control unit 125 could be detected at the terminal 160*a* of the heating resistor 150.

Also in order to monitor the proper operation of the heating circuit 140, the control unit 125 monitors the voltage of the electricity distribution network. In particular, in the exemplary embodiment here considered, the control unit 125 detects (via a voltage divider 170, such as a resistive voltage divider) the electrical potential of the phase (terminal 105*a*).

The assessment of the proper functioning of the heating circuit 140 or a malfunction or failure thereof is based on a comparison, made by the control unit 125, between the detected voltage of the electricity distribution network and the at least one measured electrical potential internal to the heating circuit.

For example, starting from the detected value of the voltage of the electricity distribution network, the control unit 125 dynamically calculates one or more comparison voltages, which are used to make a comparison with the electric potential measured in the heating circuit 140. These comparison voltage values are calculated repeatedly over time, e.g. at regular intervals, e.g. every 20-80 ms.

In particular, starting from the detected voltage of the electricity distribution network the control unit 125 calculates two reference voltage values, from which, through a mathematical calculation, two respective dimensionless (i.e., adimensional) reference numerical values XI and X2 are derived. Starting from the value of the at least one electrical potential internal to the heating circuit detected by the control unit 125, for example at the terminal 160*b* of the heating resistor 150, the control unit 125 calculates a dimensionless numerical value X. The dimensionless numerical value X is compared by the control unit 125 to the two dimensionless reference numerical values XI and X2 (with XI<X2). If the result of the comparison reveals that the value X is outside the range defined by the values XI and X2, the controller 125 declares a state of malfunction or failure of the heating circuit. As a result, the control unit 125 can for example choose to deactivate the heating circuit 140, by opening the switch 155, and/or to halt the appliance by opening the main switch 135. The control unit 125, in addition to monitoring the proper operation of the heating circuit 140 while it is activated, can monitor the operation thereof even when it is turned off (switch 155 open). For example, if the command given by the control unit 125 to the switch 155 corresponds to the opening thereof, but however the electrical potential observed at the terminal 160*b* of the heating resistor 150 is low (and in particular, the value X is lower than the reference value XI), the control unit 125 is able to determine a malfunction of the heating circuit 140, which may consist in the fact that the switch 155 is stuck closed, or that the heating resistor 150 is shorted to ground; if instead the command given by the control unit 125 to the switch 155 corresponds to the closure thereof, but the electric potential observed at the terminal 160*b* of the heating resistor 150 is relatively high (and in particular the value X is greater than the reference value X2), the control unit 125 is able to determine a malfunction of the heating circuit 140, which consists in that the heating resistor 150 is shorted to the phase voltage.

Due to the fact that the electrical potentials observed in the heating circuit 140 are compared to electrical potential values that are not predetermined, but calculated dynamically according to the value of the alternating voltage of the electricity distribution network, the monitoring of the proper functioning of the heating circuit is reliable even if the value of the alternating voltage of the electricity distribution network varies, taking into account the fact that the standard values of the network alternating voltage vary in general from country to country, and the fact that the network alternating voltage normally fluctuates over time around the nominal value.

The present invention has been described making reference to an exemplary embodiment thereof. Those skilled in the art will be able to make many variations to the embodiment described, without falling out of the protection scope set out in the following claims.

For example, in alternative embodiments, the heating circuit may include a safety switch (this could be particularly useful if the heating system is connected upstream of the main switch, so as to be able to deactivate the heating circuit in case of failure of the switch 155 without necessarily having to power down the whole appliance); the safety switch may be connected between the phase distribution line and the terminal 160*a* of the heating resistor 150, and the at least one electrical potential internal to the heating circuit detected by the control unit 125 may then be the potential at the terminal 160*a* of the heating resistor, connected to the safety switch.

The invention claimed is:

1. A household appliance comprising a heating circuit for heating a fluid, said heating circuit comprising a heating element that is selectively energized to cause the heating of the fluid and a monitoring unit for monitoring an operation of the heating circuit, said monitoring unit being configured for:

detecting, via a first voltage divider at a first time, at least one first internal electric potential that is internal to the heating circuit;

detecting, via a second voltage divider, a first value of a voltage of an electricity supply network;

calculating, using the detected first value of the voltage of the electricity supply network, first and second reference electric potentials;

comparing the at least one first internal electric potential with the first and second reference electric potentials;

determining, based on a result of the comparing the at least one first internal electric potential with the first and second reference electric potentials, whether a state of the heating circuit corresponds to a malfunction condition, wherein the state of the heating circuit corresponds to the malfunction condition in a case in which the at least one first internal electric potential does not fall within a range of values between the first and second reference electric potentials; and outputting a signal indicative of said state.

2. The appliance according to claim 1, wherein the first and second reference electric potentials are derived by the monitoring unit in a dynamic way during operation of the appliance from the detected first value of the voltage of the electricity supply network.

3. The appliance according to claim 2, in which at least one of the first and second reference electric potentials is calculated periodically.

4. The appliance according to claim 1, in which the monitoring unit is configured for:

calculating, using the detected first value of the voltage of the electricity supply network, first and second adimensional numeric values;

calculating, using the at least one first internal electric potential, a third adimensional numeric value;

comparing the third adimensional numeric value with the first and second adimensional numeric values; and determining the state of the heating circuit based upon the third adimensional numeric value falling outside a range of values between the first and second adimensional numeric values.

5. The appliance according to claim 4, in which said first and second adimensional numeric values are calculated periodically.

6. The appliance according to claim 1, in which said at least one first internal electric potential is at least one among:

an internal electric potential of a first terminal of the heating element connected to an on/off switch of the heating circuit; and an internal electric potential of a second terminal of the heating element connected to a main switch of the appliance or to a safety switch intended to switch the heating circuit off in case of malfunction of the on/off switch.

7. A method of monitoring a heating circuit of a household appliance, said heating circuit being provided for heating a fluid and comprising a heating element that is selectively energized to cause the heating of the fluid, the method comprising:

detecting, via a first voltage divider, at a first time, at least one first internal electric potential that is internal to the heating circuit;

detecting, via a second voltage divider, a first value of a voltage of an electricity supply network;

calculating, using the detected first value of the voltage of the electricity supply network, first and second reference electric potentials;

comparing the at least one first internal electric potential with the first and second reference electric potentials;

determining, based on a result of the comparing the at least one first internal electric potential with the first and second reference electric potentials, whether a state of the heating circuit corresponds to a malfunction condition, wherein the state of the heating circuit corresponds to the malfunction condition in a case in which the at least one first internal electric potential does not fall within a range of values between the first and second reference electric potentials; and outputting a signal indicative of said state.

8. The method according to claim 7, wherein the first and second reference electric potentials are derived in a dynamic way during operation of the appliance from the detected first value of the voltage of the electricity supply network.

9. The method according to claim 8, in which at least one of the first and second reference electric potentials is calculated periodically.

10. The appliance according to claim 2, in which said at least one first internal electric potential is at least one among:

an internal electric potential of a first terminal of the heating element connected to an on/off switch of the heating circuit; and an internal electric potential of a second terminal of the heating element connected to a main switch of the appliance or to a safety switch intended to switch the heating circuit off in case of malfunction of the on/off switch.

11. The appliance according to claim 3, in which said at least one first internal electric potential is at least one among:

an internal electric potential of a first terminal of the heating element connected to an on/off switch of the heating circuit; and an internal electric potential of a second terminal of the heating element connected to a main switch of the appliance or to a safety switch intended to switch the heating circuit off in case of malfunction of the on/off switch.

12. The appliance according to claim 4, in which said at least one first internal electric potential is at least one among:

an internal electric potential of a first terminal of the heating element connected to an on/off switch of the heating circuit; and an internal electric potential of a second terminal of the heating element connected to a main switch of the appliance or to a safety switch intended to switch the heating circuit off in case of malfunction of the on/off switch.

13. The appliance according to claim 1, in which the monitoring unit is configured for:

detecting, at a second time after the first time, at least one second internal electric potential that is internal to the heating circuit;

detecting a second value of the voltage of the electricity supply network;

calculating, using the detected second value of the voltage of the electricity supply network, third and fourth reference electric potentials, wherein the third and fourth reference electric potentials are different from the first and second reference potentials;

comparing the at least one second internal electric potential with the third and fourth reference potentials; and determining, based on a result of the comparing the at least one second internal electric potential with the third and fourth reference electric potentials, whether the state of the heating circuit corresponds to the malfunction condition.

14. The appliance according to claim 1, further comprising:

a phase terminal coupled to the electricity supply network to receive a phase potential;

the second voltage divider, wherein the second voltage divider is coupled between the phase terminal and the monitoring unit to receive the phase potential from the phase terminal and output an output potential to the monitoring unit, wherein the monitoring unit detects the first value based on the output potential; and a switch coupled between the phase terminal and the second heating circuit, wherein an electric current passing through the second voltage divider does not pass through the switch.

15. The appliance according to claim 1, wherein the first and second reference electric potentials are not pre-stored.

16. The appliance according to claim 1, wherein the monitoring unit repeatedly detects at least one internal electric potential and a value of the voltage of the electricity supply network at regular intervals over a period of time to obtain a plurality of internal electric potentials and a plurality of corresponding values of the voltage of the electricity supply network, and compares each of the plurality of internal electric potentials with two reference potentials derived from a corresponding value among the plurality of corresponding values.

* * * * *